US010154351B2

(12) United States Patent
Chao et al.

(10) Patent No.: US 10,154,351 B2
(45) Date of Patent: Dec. 11, 2018

(54) HEARING AID COMMUNICATION SYSTEM AND HEARING AID COMMUNICATION METHOD THEREOF

(71) Applicant: Unlimiter MFA Co., Ltd., Eden Island (SC)

(72) Inventors: Kuan-Li Chao, Taipei (TW); Kuo-Ping Yang, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 221 days.

(21) Appl. No.: 15/249,626

(22) Filed: Aug. 29, 2016

(65) Prior Publication Data

US 2017/0223469 A1 Aug. 3, 2017

(30) Foreign Application Priority Data

Feb. 3, 2016 (TW) ..... 105103629 A

(51) Int. Cl.
*H04R 25/00* (2006.01)

(52) U.S. Cl.
CPC ..... *H04R 25/43* (2013.01); *H04R 25/554* (2013.01); *H04R 2225/55* (2013.01)

(58) Field of Classification Search
CPC .. H04R 25/43; H04R 25/554; H04R 2225/55; H04R 25/00; H04R 25/552; H04R 25/556; H04R 25/558
See application file for complete search history.

(56) References Cited

U.S. PATENT DOCUMENTS

| | | | | |
|---|---|---|---|---|
| 7,596,237 | B1 * | 9/2009 | Constantin | H04R 25/552 318/2 |
| 7,599,500 | B1 * | 10/2009 | Segel | H04R 25/70 381/312 |
| 8,126,174 | B2 * | 2/2012 | Kornagel | H04R 25/00 381/312 |
| 8,340,331 | B2 * | 12/2012 | Pansell | H04R 25/55 381/314 |
| 8,571,544 | B2 * | 10/2013 | Pelland | H04M 1/0254 455/425 |
| 9,467,771 | B2 * | 10/2016 | Eckardt | H04R 1/1041 |
| 9,942,667 | B2 * | 4/2018 | Ungstrup | H04R 25/554 |
| 2004/0202340 | A1 * | 10/2004 | Armstrong | H04R 25/30 381/312 |

(Continued)

*Primary Examiner* — Oyesola C Ojo
(74) *Attorney, Agent, or Firm* — Bacon & Thomas, PLLC

(57) ABSTRACT

A hearing aid communication system and a hearing aid communication method thereof are disclosed. The hearing aid communication method includes the following steps: determining whether the sound-providing apparatus is providing a digital signal; when the sound-providing apparatus is providing a digital signal, establishing a connection with the hearing aid; determining whether the digital signal has a sound signal; if the digital signal has the sound signal, further informing the hearing aid able to execute a streaming mode; receiving the digital signal to be transferred to the hearing aid; when the sound-providing apparatus has stopped providing the digital signal with a sound signal, notifying the hearing aid that it can stop executing the streaming mode; and when the sound-providing apparatus is not providing the digital signal, breaking the connection with the hearing aid.

6 Claims, 3 Drawing Sheets

(56) References Cited

U.S. PATENT DOCUMENTS

| | | | | |
|---|---|---|---|---|
| 2011/0250932 | A1* | 10/2011 | Cohen | H04R 1/1016<br>455/569.1 |
| 2014/0105433 | A1* | 4/2014 | Goorevich | H04R 25/554<br>381/312 |
| 2014/0270287 | A1* | 9/2014 | Park | H04M 1/7253<br>381/313 |
| 2014/0321682 | A1* | 10/2014 | Kofod-Hansen | H04R 25/305<br>381/315 |
| 2015/0125013 | A1* | 5/2015 | Secall | G10L 19/167<br>381/315 |

* cited by examiner

HEARING AID COMMUNICATION SYSTEM AND HEARING AID COMMUNICATION METHOD THEREOF

BACKGROUND OF THE INVENTION

1. Field of the Invention

The present invention relates to a hearing aid communication system and a hearing aid communication method thereof; more particularly, the present invention relates to a hearing aid communication system and a hearing aid communication method thereof for notifying the hearing aid to change the usage mode.

2. Description of the Related Art

As technology develops, so do technological devices for disabled persons, such as hearing aids for assisting hearing-impaired persons. In the prior art, a new hearing aid has been developed to have multiple modes with different usage scenarios, whereby the hearing-impaired person can hear sounds from a mobile phone or television directly. For example, the hearing aid may have a microphone mode for receiving ambient sound directly, an telephony mode for transferring sound bidirectionally, or a streaming mode for receiving sound unidirectionally.

However, when the hearing aid for assisting a hearing-impaired person establishes a connection with the sound-providing apparatus, the connection status will be maintained. Even if the sound-providing apparatus does not generate a sound signal, the hearing aid will continuously maintain the connection status with the sound-providing apparatus. As a result, it is inconvenient to the hearing-impaired person that the hearing aid cannot switch to another mode automatically.

Therefore, it is necessary to invent a new hearing aid communication system and a hearing aid communication method thereof to mitigate and/or obviate the aforementioned problems.

SUMMARY OF THE INVENTION

It is an object of the present invention to provide a hearing aid communication system for notifying the hearing aid to change the usage mode.

It is another object of the present invention to provide a hearing aid communication method applied to the abovementioned hearing aid communication system.

To achieve the abovementioned object, the hearing aid communication system is used for allowing a hearing aid to receive a sound from a sound-providing apparatus, wherein the hearing aid has a streaming mode for receiving a sound in a unidirectional way. The sound-providing apparatus has a digital signal transmitting port. The hearing aid communication system comprises a digital signal receiving port, a wireless transmission module, and a processing module. The digital signal receiving port is electrically connected to the digital signal transmitting port of the sound-providing apparatus and used for receiving a digital signal from the sound-providing apparatus. The wireless transmission module is used for connecting to the hearing aid via a wireless communication path. The processing module is electrically connected to the digital signal receiving port and the wireless transmission module and used for determining whether the sound-providing apparatus is providing a digital signal; when the sound-providing apparatus is providing a digital signal, the processing module controls the wireless transmission module to establish a connection with the hearing aid, and when the processing module determines that the digital signal has a sound signal, the processing module notifies the hearing aid that it can execute the streaming mode. When the processing module determines that the sound-providing apparatus has stopped providing a digital signal with a sound signal, the processing module notifies the hearing aid that it can stop executing the streaming mode. When the sound-providing apparatus is not providing a digital signal, the processing module breaks the connection with the hearing aid.

The hearing aid communication method comprises the following steps: determining whether the sound-providing apparatus is providing a digital signal; when the sound-providing apparatus is providing the digital signal, establishing a connection with the hearing aid; determining whether the digital signal has a sound signal; if the digital signal has a sound signal, further notifying the hearing aid that it can execute the streaming mode; receiving from the sound-providing apparatus a digital signal to be transferred to the hearing aid; when the sound-providing apparatus has stopped providing a digital signal with a sound signal, notifying the hearing aid that it can stop executing the streaming mode; when the sound-providing apparatus is not providing the digital signal, breaking the connection with the hearing aid.

Other objects, advantages, and novel features of the invention will become more apparent from the following detailed description when taken in conjunction with the accompanying drawings.

BRIEF DESCRIPTION OF THE DRAWINGS

These and other objects and advantages of the present application will become apparent from the following description of the accompanying drawings, which disclose several embodiments of the present application. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
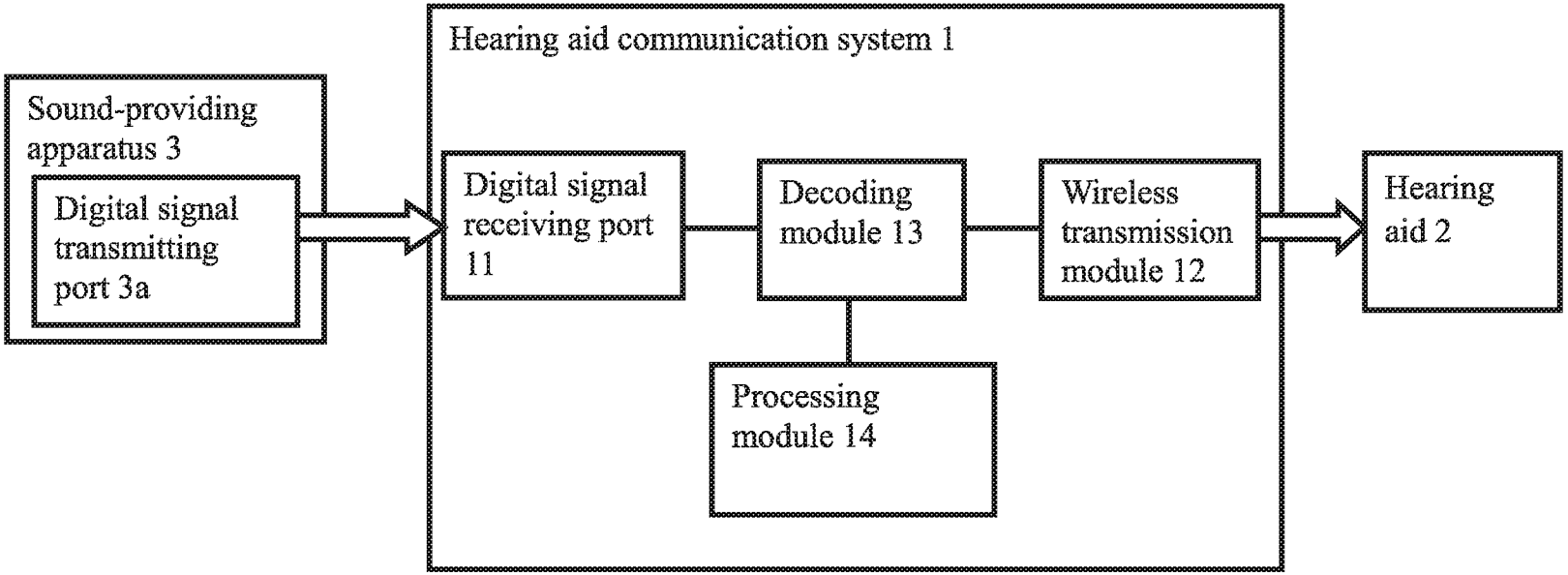
FIG. 1 illustrates a structural drawing of the hearing aid communication system of the present invention.

Please refer to FIG. 1, which illustrates a structural drawing of the hearing aid communication system of the present invention.

The hearing aid communication system 1 of the present invention is used for connecting to a sound-providing apparatus 3 and allowing a hearing aid 2 to receive a sound signal from the sound-providing apparatus 3. The hearing aid 2 can receive an external sound signal and then amplify and filter the external sound signal for provision to a hearing-impaired person. The hearing aid 2 can have a microphone mode, a telephony mode, and a streaming mode. The microphone mode provides ambient sound directly to the hearing-impaired person. The telephony mode is a mode for transferring sound in a bidirectional way so as to allow the hearing-impaired person to use a telephone. The streaming mode is a mode for receiving a sound signal in a unidirectional way so as to allow the hearing-impaired person to listen to sound from an apparatus, e.g., a television, a radio, or other audio or video player. Because the function of the hearing aid 2 is not the key element of the present invention and has been widely applied by those skilled in the art related to the present invention, there is no need for further description. The sound-providing apparatus 3 can be a television or other audio or video player, but the present invention is not limited to these apparatuses. The sound-providing apparatus 3 has a digital signal transmitting port 3*a* used for transmitting a sound signal with a digital signal format to another external device; e.g., an audio equipment.

The hearing aid communication system 1 comprises a digital signal receiving port 11, a wireless transmission module 12, a decoding module 13, and a processing module 14. The digital signal receiving port 11 is electrically connected to the corresponding digital signal transmitting port 3*a* disposed in the sound-providing apparatus 3 to receive a digital signal from the sound-providing apparatus 3. The digital signal may have a sound signal. When the sound-providing apparatus 3 is working normally, the digital signal will be transmitted continuously via the digital signal transmitting port 3*a*. The digital signal receiving port 11 and the digital signal transmitting port 3*a* of the sound-providing apparatus 3 can be an S/PDIF (Sony/Philips Digital Interface Format) port which is capable of establishing or breaking the connection automatically when the sound-providing apparatus 3 turns on or turns off. When the S/PDIF port is used, better acoustic fidelity can be generated without setting a best output volume of the sound-providing apparatus 3. However, the digital signal receiving port 11 and the digital signal transmitting port 3*a* of present invention are not limited to the S/PDIF port. The wireless transmission module 12 has a wireless communication function for connecting to the hearing aid 2 via a wireless communication path, wherein the hearing aid 2 also has the same wireless communication function. In one embodiment of the present invention, the wireless communication path can be a Bluetooth protocol, but the present invention is not limited to this wireless communication mode.

The decoding module 13 can be a decoding chip and can be electrically connected to the digital signal receiving port 11 for decoding a digital sound signal that has been encoded, encrypted, or compressed into a general uncompressed digital sound signal format. Because the decoding technology is not the key element of the present invention, there is no need for further description. Furthermore, the digital signal receiving port 11 may receive the uncompressed digital sound signal format directly. Thus, in one embodiment of the present invention, the sound signal can be processed without the decoding module 13. The processing module 14 is electrically connected to the digital signal receiving port 11 and the wireless transmission module 12 for determining whether the sound-providing apparatus 3 provides the digital signal. It is noted that if an analogue signal is used, the processing module 14 cannot distinguish between a silent segment of the sound and no signal. However, a digital signal generally has signal flags or package flags at the beginning and end. In addition, a digital signal is usually encrypted or compressed. Therefore, there is a signal even when a silent segment is transmitted. Furthermore, there is also a reference clock when the digital signal is transmitted. If no digital signal is generated, no reference clock will be detected. As a result, in one embodiment of the present invention, the sound-providing apparatus 3 provides a digital signal. Thus, it can be determined whether the sound-providing apparatus 3 is still functioning according to the digital sound signal. When the sound-providing apparatus 3 provides a digital signal, the processing module 14 controls the wireless transmission module 12 to establish the connection with the hearing aid 2 and further determines whether the digital signal has a sound signal. A digital signal may have a sound flag record; an invalid sound flag record can be regarded as a no-sound signal, and a valid sound flag record can be regarded as a sound signal. As a result, when it is determined that the digital signal has a sound signal, the processing module 14 notifies the hearing aid 2 that it can execute a streaming mode, such that the decoded sound signal can be transmitted to the hearing aid 2. Therefore, the hearing aid 2 can be notified when the sound-providing apparatus 3 starts providing the digital signal so as to determine whether to establish the connection with the hearing aid communication system 1 or not and execute the streaming mode when the sound signal is generated to allow a hearing impaired person to hear the sound signal provided by the sound-providing apparatus 3. In addition, when the sound-providing apparatus 3 is providing the sound signal continuously, the processing module 14 controls the wireless transmission module 12 to maintain the connection with the hearing aid 2 and notifies the hearing aid 2 to execute the streaming mode continuously. Furthermore, when the processing module 14 determines that the sound-providing apparatus 3 is not providing the digital signal with the sound signal, the processing module 14 notifies the hearing aid 2 that it can stop executing the streaming mode. Thus, the hearing aid 2 can execute a telephony mode or a microphone mode. Besides, when the sound-providing apparatus 3 is not providing the digital signal, the processing module 14 further controls the wireless transmission module 12 to break the connection with the hearing aid 2.

In one embodiment of the present invention, one situation in which the processing module 14 determines that the sound-providing apparatus 3 is not providing a sound signal can be that the sound-providing apparatus 3 is providing a silent signal. When the sound-providing apparatus 3 provides a silent signal having a valid sound flag record for a specific length of time, e.g., 3 seconds or 10 seconds, the processing module 14 controls the wireless transmission module 12 to break the connection with the hearing aid 2. Whether the sound-providing apparatus 3 provides a digital signal with a sound signal or a digital signal with a short segment of silence (i.e., the sound flag record of the digital signal is a valid sound flag record but the digital signal is a silent signal), the hearing aid 2 will continue to execute the streaming mode. The hearing aid 2 will not interpret the short silence (i.e., the sound flag record of the digital signal is a valid sound flag record but the digital signal is a silent signal) as the sound-providing apparatus 3 having shut down and consequently stop executing the streaming mode. In another embodiment of the present invention, when the processing module 14 determines that the sound-providing apparatus 3 is not providing a sound signal (i.e., the sound flag record of the digital signal is an invalid sound flag record), the processing module 14 notifies the hearing aid 2 that it can execute the telephony mode or the microphone mode again. When the sound-providing apparatus 3 is not providing a digital signal, the processing module 14 will control the wireless transmission module 12 to break the connection with the hearing aid 2.

It is to be known that each module of the hearing aid communication system 1 can be a hardware device, a software program combined with the hardware device, or a firmware combined with the hardware device, such as an application product stored in a computer access media, but the present invention is not thus limited. Moreover, the present embodiment is intended to show a preferred embodiment of the present invention. To avoid further description, not all of the possible changes and combinations are described in detail. However, persons of ordinary skill in the art of the present invention may recognize that the abovementioned modules or units may not be necessary. To implement the present invention, the invention may also include other modules or units of the prior art. Each module or unit may be omitted or replaced based on requirements, and other modules or units may be installed between any two modules.

Figure 2:
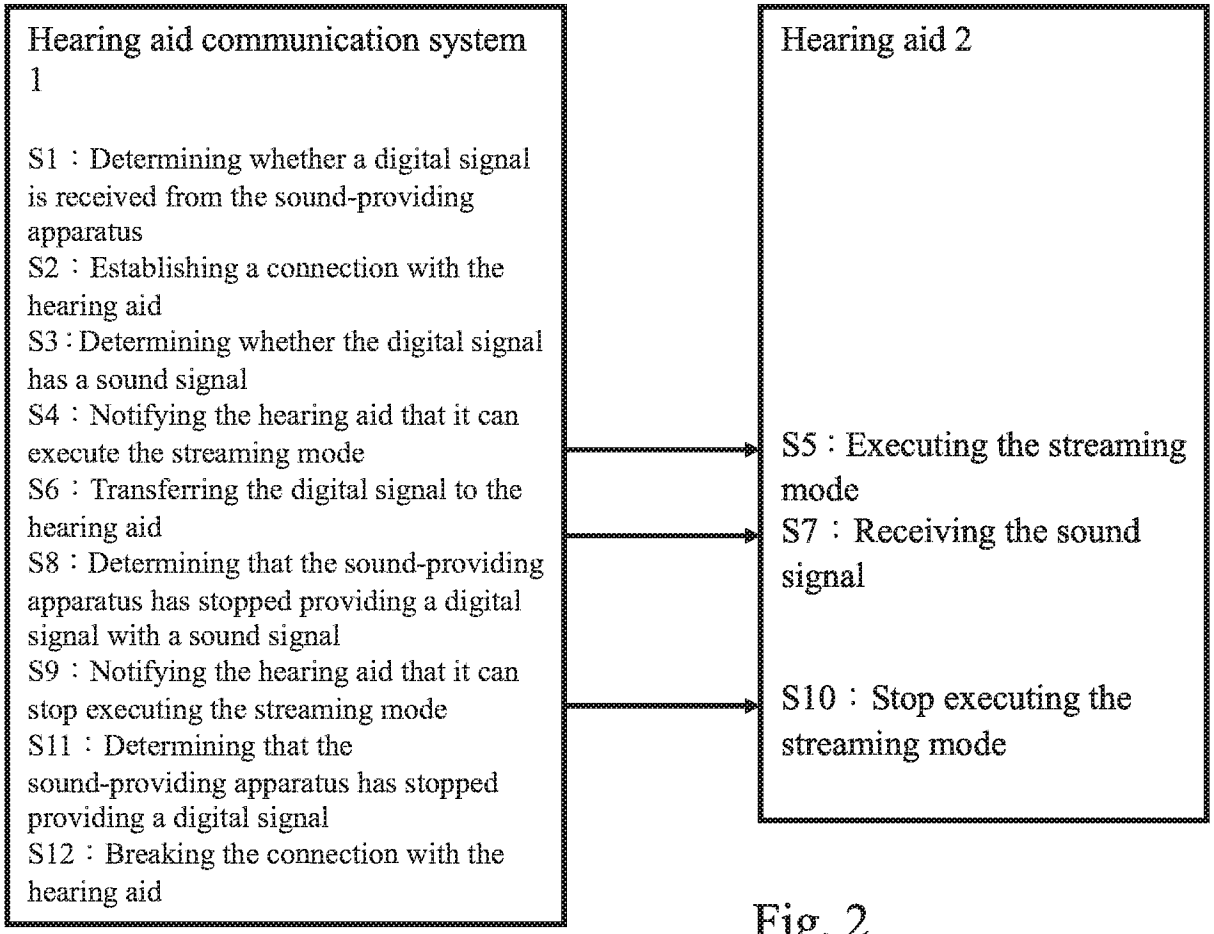
FIG. 2 illustrates a flowchart of the hearing aid communication method of the present invention.

Please refer to FIG. 2, which illustrates a flowchart of the hearing aid communication method of the present invention. It is to be known that, although the following description uses the abovementioned hearing aid communication system 1 to describe the hearing aid communication method of the present invention, the hearing aid communication method of the present invention is not limited to the same structure as the hearing aid communication system 1.

First, Step S1 is executed: determining whether a digital signal is received from the sound-providing apparatus.

First, the digital signal receiving port 11 is electrically connected to a corresponding digital signal transmitting port 3*a* of a sound-providing apparatus 3. Thus the processing module 14 is used for determining whether a digital signal is received from the sound-providing apparatus 3.

If the sound-providing apparatus 3 provides a digital signal, then Step S2 is executed: establishing a connection with the hearing aid.

When the sound-providing apparatus 3 is providing a digital signal, the processing module 14 will control the wireless transmission module 12 to establish a connection with the hearing aid 2. Thus the hearing aid 2 can establish a connection with the wireless transmission module 12 to transmit the signal via a wireless communication path; e.g., a Bluetooth protocol.

Then Step S3 is executed: determining whether the digital signal has a sound signal.

Figure 3:
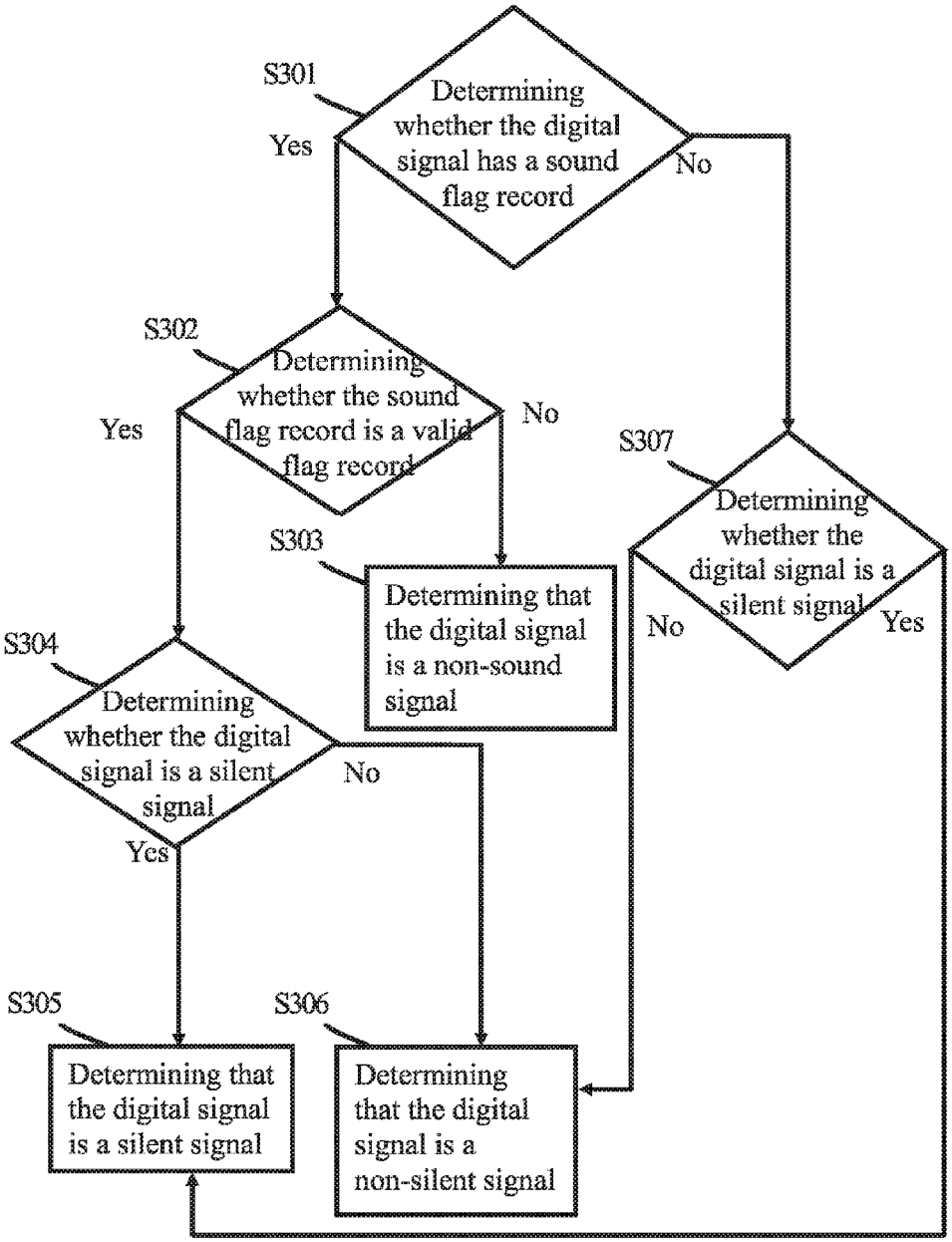
FIG. 3 illustrates a flowchart of the process of determining whether the digital signal has a sound signal of the present invention.

After the processing module 14 controls the wireless transmission module 12 to establish the connection with the hearing aid 2, the processing module 14 determines whether the digital signal has a sound signal. Step S3 is illustrated in FIG. 3, which presents a flowchart of the method of determining whether the digital signal has a sound of the present invention.

Because the method of determining whether the digital signal has a sound is a key feature of the present invention, Step S301 can be executed first: determining whether the digital signal has a sound flag record.

In this step, the processing module 14 determines whether there is a sound flag record in the digital signal.

When the processing module 14 determines that the digital signal has a sound flag record, Step S302 is executed: determining whether the sound flag record is a valid flag record.

The processing module 14 determines whether the sound flag record is a valid flag record or an invalid sound record.

If the sound flag record is an invalid flag record, Step S303 is executed: determining that the digital signal is a non-sound signal.

The processing module 14 will determine that the digital signal is a non-sound signal.

When the processing module 14 determines that the sound flag record is a valid flag record in Step S302, Step S304 is executed: determining whether the digital signal is a silent signal.

The processing module 14 further determines whether the digital signal is a silent signal.

If yes, then Step S305 is executed: determining that the digital signal is a silent signal.

If no, then Step S306 is executed: determining that the digital signal is a non-silent signal.

Furthermore, it is possible that the digital signal does not have a sound flag record. When the processing module 14 determines that the digital signal does not have a sound flag record, Step 307 is executed: determining that the digital signal is a silent signal. Then the processing module 14 will execute Step S305 or. Step S306.

Therefore, after the steps in FIG. 3 are executed, if the digital signal has a sound signal, the processing module 14 will execute Step S4: notifying the hearing aid that it can execute the streaming mode.

When the sound flag record provided by the sound-providing apparatus is a valid flag record and the digital signal is a non-silent signal, or the sound signal does not have a sound flag record but is a non-silent signal (i.e., Step S306), the processing module 14 will notify the hearing aid 2 that it can execute the streaming mode to transfer the decode sound signal to the hearing aid 2.

Therefore, the hearing aid 2 will decide whether to execute Step S5 or not: executing the streaming mode.

At this time, the hearing aid 2 is notified that the digital signal will be transferred by the processing module 14. Thus the hearing aid 2 can decide whether to execute the streaming mode or not. It is noted that if the hearing aid 2 is executing the telephony mode or the microphone mode, the hearing aid 2 can decide not to execute the streaming mode.

Then the processing module 14 executes Step S6: transferring the digital signal to the hearing aid.

Then the decoding module 13 can decode the encoded, encrypted, or compressed sound signal that is received from the digital signal receiving port 11 into a general uncompressed digital sound signal format. The processing module 14 then transmits the sound signal to the hearing aid 2 via the wireless transmission module 12.

Then the hearing aid 2 will execute Step S7: receiving the sound signal.

Thus, the hearing aid 2 can establish a connection with the sound-providing apparatus 3 immediately when the sound-providing apparatus 3 starts providing a sound signal and switch to the streaming mode to receive the sound signal. In one embodiment of the present invention, when the sound-providing apparatus 3 is providing a digital sound signal continuously, the processing module 14 notifies the hearing aid 2 that it can continue executing the streaming mode continuously.

Then Step S8 is executed: determining that the sound-providing apparatus has stopped providing a digital signal with a sound signal.

Then the processing module 14 determines that the sound-providing apparatus 3 has stopped providing a sound signal (i.e., stopped providing a digital signal with a sound signal, as mentioned in Steps S301 to S307). For example, when the processing module 14 determines that the sound flag record provided by the sound-providing apparatus is an invalid flag record (Step S303), that the sound flag record is a valid flag record but the segment is a silence for a specific length of time (Step S305), or that the sound-providing apparatus 3 is not providing a sound flag record and the sound is silence for a specific length of time (Step S305), the processing module 14 will determine that the sound-providing apparatus 3 has stopped providing a sound signal.

Then Step S9 is executed: notifying the hearing aid that it can stop executing the streaming mode.

When the processing module 14 determines that the digital sound signal is not being received from the sound-providing apparatus 3 or the sound-providing apparatus 3 has provided a silent signal for a specific length of time, the processing module 14 notifies the hearing aid 2 that it can stop executing the streaming mode.

As a result, the hearing aid 2 will determine whether to execute Step S10: stop executing the streaming mode.

In Step S10, when the hearing aid 2 is notified by the processing module 14 that no sound signal is transferred, the hearing aid 2 will determine whether or not to switch the streaming mode to other modes, such as the telephony mode or the microphone mode. But the present invention is not thus limited. The hearing aid 2 can continue executing the streaming mode. Furthermore, in one embodiment of the present invention, if the processing module 14 notifies the hearing aid 2 that it can stop executing the streaming mode because a non-sound signal is received, the processing module 14 can still allow the wireless transmission module 12 to maintain the connection with the hearing aid 2. Thus, when the sound-providing apparatus 3 provides a sound signal again, Step S3 will be executed directly. It is not necessary to execute Step S2 to establish the connection again.

Then Step S11 is executed: determining that the sound-providing apparatus has stopped providing a digital signal.

Then the processing module 14 determines whether the sound-providing apparatus is providing a digital signal continuously.

Finally, if the processing module 14 determines that the sound-providing apparatus 3 has stopped providing a digital signal, Step S12 is executed: breaking the connection with the hearing aid.

When the processing module 14 determines that the sound-providing apparatus 3 is not providing a digital signal, the processing module 14 controls the wireless transmission module 12 to break the connection with the hearing aid 2.

It is to be known that the order of the steps of the hearing aid communication method of the present invention is not limited to the abovementioned description and that the abovementioned order of steps can be changed as long as the object of the present invention can be achieved.

As described above, the present invention allows a hearing-impaired person to hear a sound from a sound-providing apparatus 3 conveniently and allows a hearing aid 2 to continue executing a streaming mode. The hearing aid communication system 1 will not arbitrarily determine that the sound-providing apparatus 3 is not functioning when a silent signal is provided and consequently switch the operation mode.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope of the invention.

What is claimed is:

1. A hearing aid communication system, used for allowing a hearing aid to receive a sound from a sound-providing apparatus, wherein the hearing aid has a streaming mode for receiving the sound in an unidirectional way and further comprises an telephony mode for transferring sound in bidirectional way and a microphone mode for receiving an ambient sound; the sound-providing apparatus has a digital signal transmitting port, the hearing aid communication system comprising:

a digital signal receiving port, electrically connected to the digital signal transmitting port of the sound-providing apparatus, used for receiving a digital signal from the sound-providing apparatus; wherein the digital signal has a sound flag record;

a wireless transmission module, used for connecting to the hearing aid via a wireless communication path; and a processing module, electrically connected to the digital signal receiving port and the wireless transmission module, used for determining whether the sound-providing apparatus is providing the digital signal; wherein when the sound-providing apparatus is providing the digital signal, the processing module controls the wireless transmission module to establish a connection with the hearing aid; and when the processing module determines that the digital signal has a sound signal, notifying the hearing aid that it can execute the streaming mode; when the processing module determines that the sound-providing apparatus has stopped providing the digital signal with the sound signal, when the sound flag record provided by the sound-providing apparatus is an invalid flag record, or when the sound flag record is a valid flag record but the digital signal is a silent signal for a specific length of time, the processing module notifies the hearing aid that it can stop executing the streaming mode to execute the telephony mode or the microphone mode; and when the sound-providing apparatus is not providing the digital signal, the processing module breaks the connection with the hearing aid.

2. The hearing aid communication system as claimed in claim 1, wherein if the digital signal has no sound flag record but the digital signal is a silent signal for a specific length of time, the processing module notifies the hearing aid that it can execute the telephony mode or the microphone mode.

3. A hearing aid communication method, used for allowing a hearing aid to receive a sound from a sound-providing apparatus, wherein the hearing aid has a streaming mode for receiving the sound in an unidirectional way and further comprises a telephony mode for transferring sound in a bidirectional way and a microphone mode for receiving ambient sound, the method comprising:

determining whether the sound-providing apparatus is providing a digital signal, wherein the digital signal has a sound flag record;

when the sound-providing apparatus is providing the digital signal, establishing a connection with the hearing aid;

determining whether the digital signal has a sound signal;

if the digital signal has the sound signal, further notifying the hearing aid that it can execute the streaming mode;

receiving from the sound-providing apparatus the digital signal to be transferred to the hearing aid;

when the sound-providing apparatus stops providing the digital signal with the sound signal or determining the sound flag record provided by the sound-providing apparatus is an invalid flag record, or that the sound flag record is a valid flag record but the digital signal is a silent signal for a specific length of time, notifying the hearing aid that it can stop executing the streaming mode to execute the telephony mode or the microphone mode; and when the sound-providing apparatus is not providing the digital signal, breaking the connection with the hearing aid.

4. The hearing aid communication method as claimed in claim 3, wherein if the digital signal has no sound flag record, the step of determining whether the sound-providing apparatus has stopped providing the digital signal with the sound signal further comprises:

determining that the sound-providing apparatus provides a silent signal for a specific length of time; and notifying the hearing aid that it can execute the telephony mode or the microphone mode.

5. The hearing aid communication system as claimed in claim 1, wherein when the sound-providing apparatus provides the sound signal continuously, the processing module notifies the hearing aid that it can execute the streaming mode continuously.

6. The hearing aid communication method as claimed in claim 3, further comprises a step of: when the sound-providing apparatus provides the sound signal continuously, notifying the hearing aid that it can execute the streaming mode continuously.

* * * * *